United States Patent [19]

Kennel

[11] Patent Number: 4,846,401

[45] Date of Patent: Jul. 11, 1989

[54] TIE-DOWN SYSTEM FOR RAILROAD GRADE CROSSING

[75] Inventor: Gerald R. Kennel, Hillsboro, Oreg.

[73] Assignee: Riedel Omni Products, Inc., Portland, Oreg.

[21] Appl. No.: 176,684

[22] Filed: Apr. 1, 1988

[51] Int. Cl.[4] ..... E01C 9/04

[52] U.S. Cl. ..... 238/7; 238/8

[58] Field of Search ..... 238/7, 8, 152, 40, 2

[56] References Cited

U.S. PATENT DOCUMENTS

| | | | |
|---|---|---|---|
| 3,317,137 | 5/1967 | Harmon | 238/8 |
| 4,117,977 | 10/1978 | Whitlock | 238/8 |
| 4,279,532 | 7/1981 | Miller | 238/8 |
| 4,545,527 | 10/1985 | Young | 238/8 |
| 4,641,779 | 2/1987 | O'Brien et al. | 238/8 |

FOREIGN PATENT DOCUMENTS

| | | | |
|---|---|---|---|
| 2843748 | 4/1979 | Fed. Rep. of Germany | 238/8 |

*Primary Examiner*—Sherman D. Basinger
*Assistant Examiner*—Stephen P. Avila
*Attorney, Agent, or Firm*—Chernoff, Vilhauer, McClung & Stenzel

[57] ABSTRACT

The railroad crossing tie-down system of the present invention includes anchor plates which are attached permanently to railroad ties with the side margins of the anchor plates projecting outwardly from the sides of the ties. The crossing elements which will be attached by the system have openings passing through them at selected locations midway between adjacent ties. Cross tie beams having nuts located at their centers have a length which is slightly greater than the distance between adjacent ties. Elongate bolts which extend through the openings in the crossing elements have threaded extremeties which will engage the nuts. Before the crossing elements are installed on the anchor plates the bolts are inserted through the openings and the cross tie beams are attached to them and are oriented so that the cross tie beams are parallel with the ties. After the crossing elements have been installed on the anchor pads the bolts are tightened which first causes the cross tie beams to rotate until their ends become jammed against the sides of the ties and then to be drawn up against the overhanging side margins of the anchor plates. Thus the side margins are squeezed between the crossing elements and the cross tie beams which attaches the crossing elements to the anchor plates.

6 Claims, 1 Drawing Sheet

TIE-DOWN SYSTEM FOR RAILROAD GRADE CROSSING

BACKGROUND AND SUMMARY OF THE INVENTION

This invention relates to the attachment of railroad grade crossing elements to railroad ties, and in particular to the attachment of rubber grade crossing elements to concrete ties.

Whenever a roadway crosses a railroad track, a grade crossing must be installed to bring the space above the ties up to the level of rails. In the past when both the grade crossing elements and ties were wood this was easily accomplished by driving spikes through the grade crossing elements into the underlying ties. Now that railroad ties are made of concrete this method of attaching the grade crossing elements to them no longer is possible.

While lag bolts and expandable anchors can be used for this purpose, drilling the holes necessary for the anchors is a time-consuming and costly process. In addition, since concrete ties are pre-stressed, any holes drilled in them have to be carefully placed and drilled to keep from reducing the strength of the tie. Accordingly, using anchors and bolts to attach grade crossing elements to concrete ties is extremely expensive.

Another method for attaching grade crossing elements to concrete ties is to bond them together with a high-strength adhesive. This has two problems associated with it, however. One problem is that many concrete ties have concave indentations in their top surfaces between the rails, in order to reduce the material cost and the weight of the ties. In addition, these indentations have different shapes in ties made by different manufacturers. Thus, filler pads must be bonded to each tie before the crossing element can be adhered to it. This increases the labor cost of attaching the grade crossing as well as possibly interrupting the attachment process while the adhesive used to bond the filler pad dries. A greater difficulty with adhesively bonding crossing elements to ties is that the concrete ties and rubber crossing elements now in use are extremely long-lived. Accordingly, it is necessary to remove the crossing elements from the ties occasionally to retamp the bed the railroad is constructed on, and then to reattach the crossing elements to the ties. This cannot easily be accomplished when the crossing elements are adhesively bonded to the ties in the first instance.

What is needed, therefore, is a tie-down system which allows any type of railroad grade crossing elements to be attached to any type of railroad ties in a manner which permits them to easily be removed and then reinstalled.

This is accomplished in the present invention by attaching anchor plates to the top surfaces of the ties by mechanical fasteners or an adhesive, depending upon the material the ties and anchor plates are constructed from. The anchor plates substantially cover the entire length of the ties which do not have rails attached to them, and have a width which is greater than the width of the ties. Thus the anchor plates have side margins which extend outwardly from the sides of the ties. In addition, the bottoms of the anchor plates can be contoured to fill any cavities which are formed in the tops of the ties, thereby allowing the cavities to be filled and the anchor plates attached in a single operation. Openings are placed in the crossing elements above the side margins of the anchor plates, and clamps, which are attached to the crossing elements and extend under the side margins of the anchor plates, can be tightened from above through these openings to squeeze the side margins between the crossing elements and the clamp.

In a preferred embodiment of the invention, the openings are centered between adjacent ties and the clamp includes an elongate cross tie beam which has a length that is slightly greater than the distance between adjacent ties. The cross tie beam has a lock nut fixedly attached to its center which engages a bolt that fits through an opening in a crossing element. The cross tie beam is attached loosely to the bolt and the cross tie beam is oriented parallel with the ties before the crossing element is placed on top of the anchor plates. Once the crossing element is in place the bolt is turned in a direction which would cause it to be threaded into the nut. When this occurs the cross tie beam will rotate with the bolt until its ends contact the sides of the ties. The cross tie beam then will become jammed and further tightening of the bolt will cause the cross tie beam to be drawn up toward the side margins of the anchor plates. When fully tightened the cross tie beam will engage the side margins of the anchor plates and clamp the crossing element to the anchor plates.

Accordingly, it is a principal object of the present invention to provide a system for attaching railroad grade crossing elements releasably to the ties which support them.

It is a further object of the present invention to provide such a system which will work for ties and crossing elements made from any type of material.

The foregoing and other objectives, features and advantages of the present invention will be more readily understood upon consideration of the following detailed description of the invention taken in conjunction with the accompanying drawings.

DETAILED DESCRIPTION OF A PREFERRED EMBODIMENT

Figure 1:
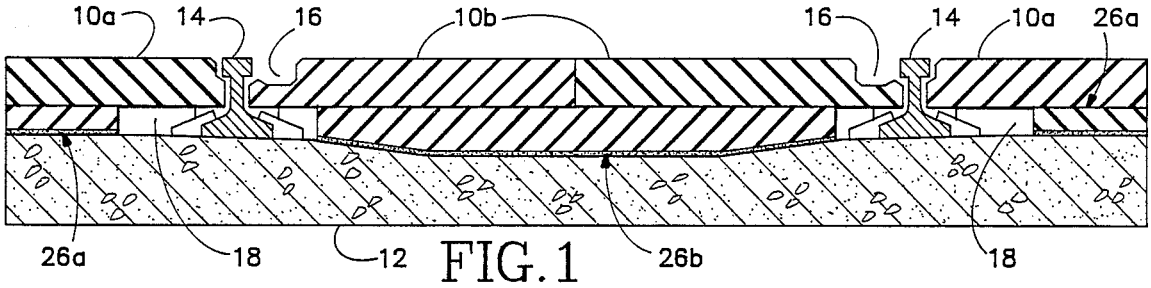
FIG. 1 is a side elevation view, in cross section, showing a railroad grade crossing attached by a tie down system embodying the present invention.
Figure 2:
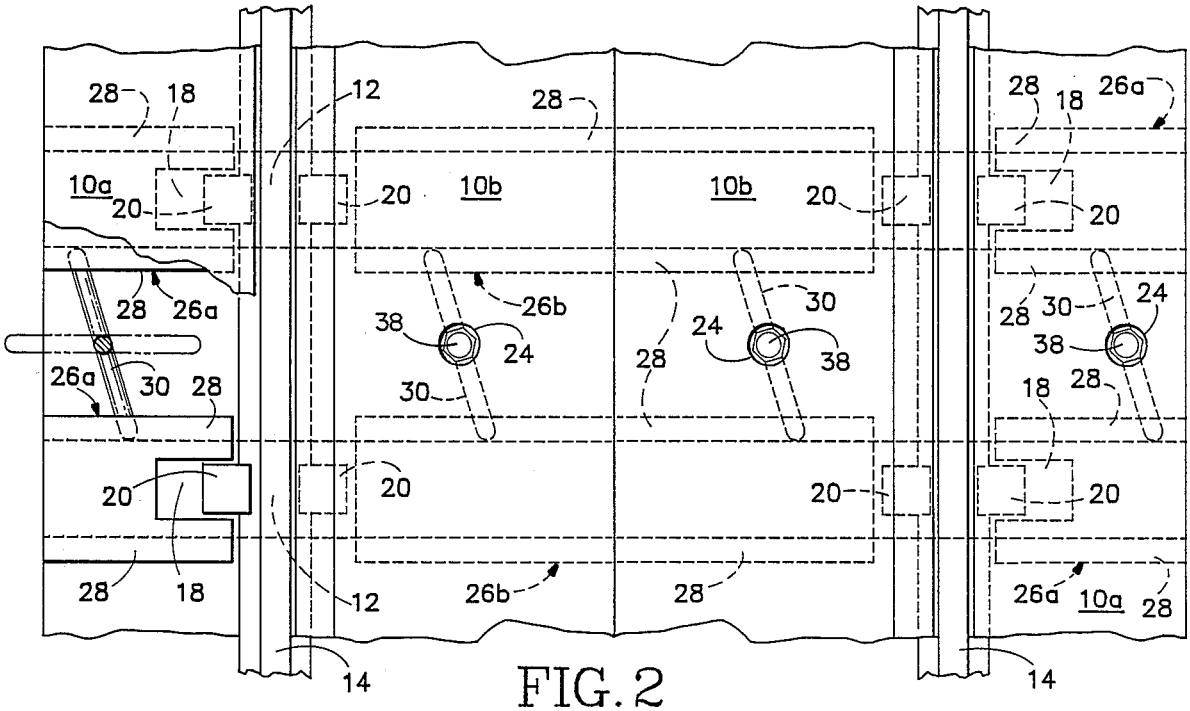
FIG. 2 is a fragmentary plan view, partially broken away to show hidden detail, of the railroad grade crossing of FIG. 1.

Referring to FIGS. 1 and 2 of the drawings, the tie down system of the present invention is used to attach grade crossing elements 10 to ties 12 which support one or more sets of rails 14 which are being crossed. In the embodiment illustrated, the crossing elements are a hard rubber or elastomeric material and are constructed according to Trichel et al., U.S. Pat. No. 4,365,473. In addition, the ties illustrated in the drawings are cast prestressed concrete. While the Trichel et al. rubber crossing and concrete ties are preferable, the tie down system of the present invention works equally well with crossing elements and ties of any material.

The crossing elements 10 are divided into side elements 10*a*, which extend between the outside of the rails and the sides of the crossing, and center elements 10*b*, which extend between the rails. In the embodiment illustrated, there are two side-by-side center elements, however, they could be one piece if desired. The crossing elements can have a length which will allow them to span the entire width of the crossing, but probably will be divided into several shorter sections. The side crossing elements 10*a* extend right up the rails and the center elements 10*b* contain a space 16 for receiving the flanges of railroad car wheels according to the standard practice. The crossing elements also contain notches 18 which fit around the clips 20 which clamp the rails to the ties. Located at spaced intervals along the length of the crossing elements, at points which preferably are midway between adjacent ties, are cylindrical openings 22 which have larger diameter counterbores 24 located at their upper ends.

Figure 3:
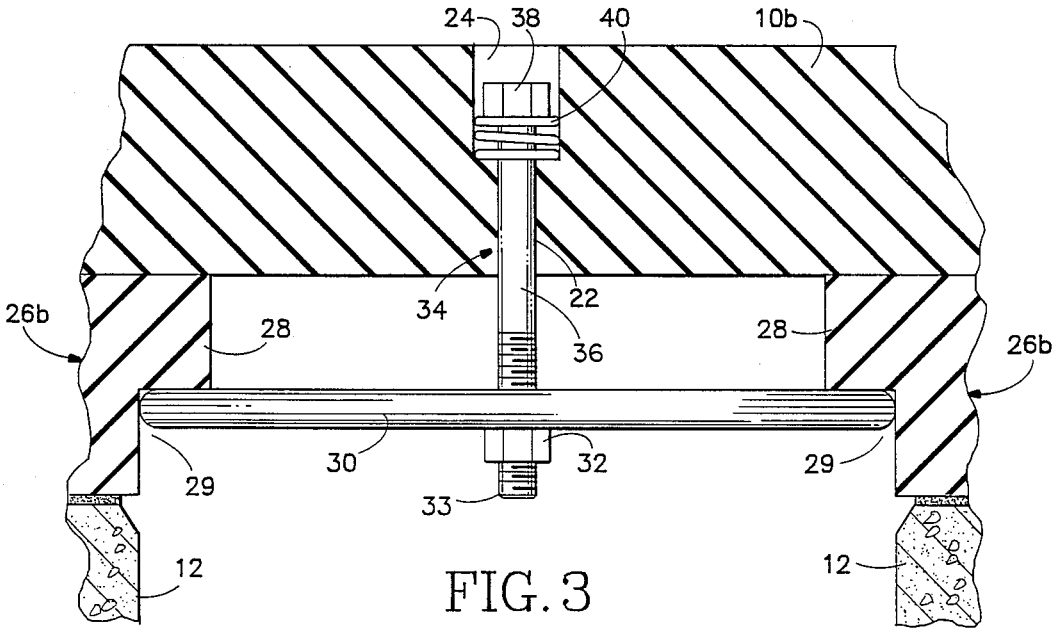
FIG. 3 is a fragmentary side elevation view, at an enlarged scale, showing details of the tie down system.

The crossing elements are supported by anchor plates 26 which are attached to the tops of the ties. The anchor plates can be made from any material which will support the load being carried on the crossing elements, but in the preferred embodiment are made of the same rubber compound that the crossing elements are made from. The anchor plates include side plates 26*a* which extend between the rails and the ends of the ties, and center plates 26*b*, which extend between the rails. The concrete ties illustrated have concave center portions in order to save material. Accordingly, the center plates 26*b* have convex projections protruding from them which fit conformingly into the concave center portions of the ties. The anchor plates are wider than the ties and are attached to the ties in a manner such that their side margins 28 extend outwardly from the sides of the ties. In the case of the center plates 26*b* with concave projections, the side margins 28 may be undercut, as shown at 29 in FIG. 3, to make them have the same height as the side margins on the side plates. The anchor plates can be attached to the ties with mechanical fasteners, such as spikes or bolts, or by means of an adhesive, depending on the material the ties are constructed from. With the concrete ties illustrated the latter form of attachment is preferred.

The outwardly-extending side margins 28 of the anchor plates 26 are used to clamp the crossing elements 10 to the anchor plates. In the embodiment illustrated this is accomplished with an elongate cross tie beam 30, FIG. 3, which has a length which is slightly greater than the distance between adjacent ties 12. Located in the center of the cross tie beam 30 is a lock nut 32 which is attached to the cross tie beam by means such as welding and is configured to receive the threaded end 33 of an elongate bolt 34. The shaft 32 of the bolt 34 fits loosely in the opening 22 in the crossing element and its head 38 fits in the counterbore 24 with enough clearance to permit a socket to engage it. While the nut is shown in the drawings as a separate item which is attached to the cross tie beam, the nut and cross tie beam could be combined as a single integral element The cross tie beam also can have many different cross-sectional shapes and can be made from a wide variety of materials including a large number of metal and plastic compounds.

The clamp is installed by placing the bolt 34 through the appropriate opening 22 in a crossing element and attaching the nut 32 to its threaded extremity 33. The cross tie beam 30 then is oriented so that it is parallel with the length of the ties and the crossing element is placed on top of the anchor plates 28. A wrench (not shown) is placed on the head 38 of the bolt and is rotated in a direction which will cause the bolt to be threaded into the nut. Initially the cross tie beam 30 will rotate with the bolt, however, since it is longer than the distance between the ties, its ends will contact the sides of the ties. (In the case of the center plates which have the undercut portions 29 formed in them the ends of the cross tie beam will contact the sides of the anchor plates instead ) When this occurs the cross tie beam cannot continue to rotate and further rotation of the bolt causes the cross tie beam to be drawn up toward the side margins 28. When the cross tie beam contacts the side margins further tightening of the bolt causes the side margins to be clamped between the cross tie beam and the crossing element thereby securing the crossing element to the anchor plates, and thus to the ties to which the anchor plates are attached. In order to prevent the clamp from becoming unloaded when the crossing element is compressed or deflected due to traffic, a compression spring 40 is placed under the head 38. The same result could be accomplished by making other elements, such as the cross tie beam itself deflectable.

While the preferred embodiment uses a cross tie beam 30 with a nut 32 located in its center, and the openings 22 in the crossing elements are centered between the ties, other clamping arrangements would work as well. For example, the nut 32 and opening 22 could be offset to one side of the space between the ties. In addition, the opening could be located directly above one of the side margins 28 of the anchor plates 26 and a short cross beam could be used to engage one side margin only.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A tie-down system for attaching a railroad grade crossing to the ties which support the rails being crossed, comprising:

(a) crossing elements which substantially fill the open space above the ties;

(b) anchor plate means for supporting said crossing elements a predetermined distance above the uppermost surface of the ties;

(c) means for attaching said anchor plate means to the ties with the side margins of the anchor plate means on selected adjacent pairs of ties extending outwardly from the facing sides of said ties so as to form gaps between said side margins having a predetermined size;

(d) said crossing elements having openings passing therethrough in locations above said gaps;

(e) elongate cross tie beams having a width which is less than said predetermined gap size and a length which is greater than said predetermined gap size;

(f) means for orienting said cross tie beams between said adjacent pairs of ties so that they engage the side margines of the anchor plates attached to said ties; and (g) fastener means, which extend through said openings, or engaging said cross tie beams and drawing said cross tie beams against said side margins so as to clamp said side margins between said cross tie beams and said crossing elements.

2. The tie-down system of claim 1 wherein said cross tie beams have nuts fixedly attached thereto intermediate their ends for engaging a threaded element and said fastener means comprises:

(a) bolts having elongate shafts with threaded ends which are engageable by said nuts and heads which are engageable by a wrench; and (b) said openings in said crossing elements are dimensioned to permit said shafts to pass therethrough and to prevent said heads from passing therethrough and are located the same relative distance between the adjacent pairs of ties that said nuts are located between the ends of said cross tie beams.

3. The tie-down system of claim 2 wherein said cross tie beams have a length which is slightly greater than the distance between said adjacent pair of ties.

4. The tie-down system of claim 2 wherein said openings include enlarged portions at the upper ends thereof which will receive said heads.

5. The tie-down system of claim 4, including a compressible element which interfits between said head and said crossing element.

6. The tie-down system of claim 1 wherein the ties have concave center portions, and the anchor plate means includes a concave projecting portion which fills said concave center portions of the ties.

* * * * *